United States Patent [19]

Platt

[11] 4,333,328

[45] Jun. 8, 1982

[54] ACCESS IDENTIFICATION APPARATUS

[75] Inventor: John D. Platt, S. Laguna, Calif.

[73] Assignee: A.R.M., Costa Mesa, Calif.

[21] Appl. No.: 146,009

[22] Filed: May 2, 1980

[51] Int. Cl.[3] ..... E05B 49/00; H01H 9/28

[52] U.S. Cl. ..... 70/278; 70/279; 200/44

[58] Field of Search ..... 70/278, 279; 200/42 R, 200/43–45

[56] References Cited

U.S. PATENT DOCUMENTS

| | | | |
|---|---|---|---|
| 1,666,320 | 4/1928 | Watts | 200/42 R |
| 2,637,844 | 5/1953 | Thompson | 200/42 R X |
| 3,415,087 | 12/1968 | Kramasz, Jr. et al. . | |
| 3,500,326 | 3/1970 | Benford | 70/278 X |
| 3,599,454 | 8/1971 | Hill et al. . | |
| 3,631,301 | 12/1971 | Goldman . | |
| 3,654,522 | 4/1972 | Isserstedt . | |
| 3,673,569 | 6/1972 | Hedin et al. . | |
| 3,694,810 | 9/1972 | Mullens et al. . | |
| 3,782,148 | 1/1974 | Goldman | 70/278 |
| 3,787,812 | 1/1974 | Armstrong | 70/278 X |
| 3,800,284 | 3/1974 | Zucker et al. . | |
| 3,873,019 | 3/1975 | Holcomb . | |
| 4,023,161 | 5/1977 | Sasaki . | |
| 4,067,486 | 1/1978 | Hyde et al. . | |
| 4,198,552 | 4/1980 | Tahara | 200/44 |

*Primary Examiner*—William E. Lyddane

*Attorney, Agent, or Firm*—William W. Haefliger

[57] ABSTRACT

Access identification apparatus which includes key operated switch actuating plates with exterior tangs that rock in one rotary direction to rock switch actuating elements in the opposite angular direction.

26 Claims, 18 Drawing Figures

FIG. 4.
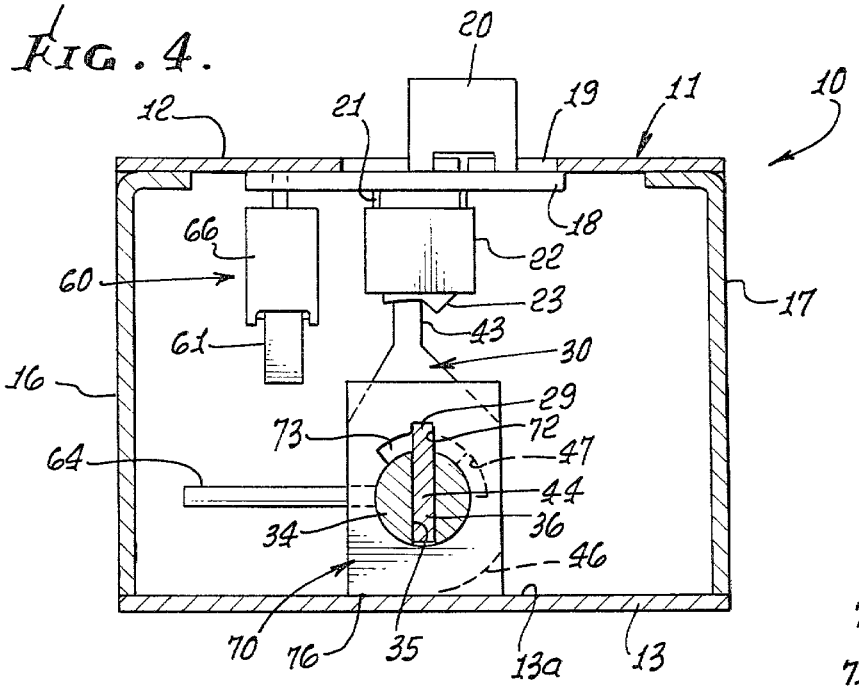
FIG. 7.
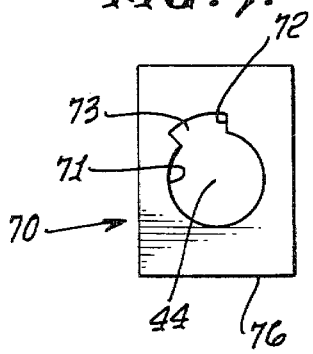
FIG. 5.
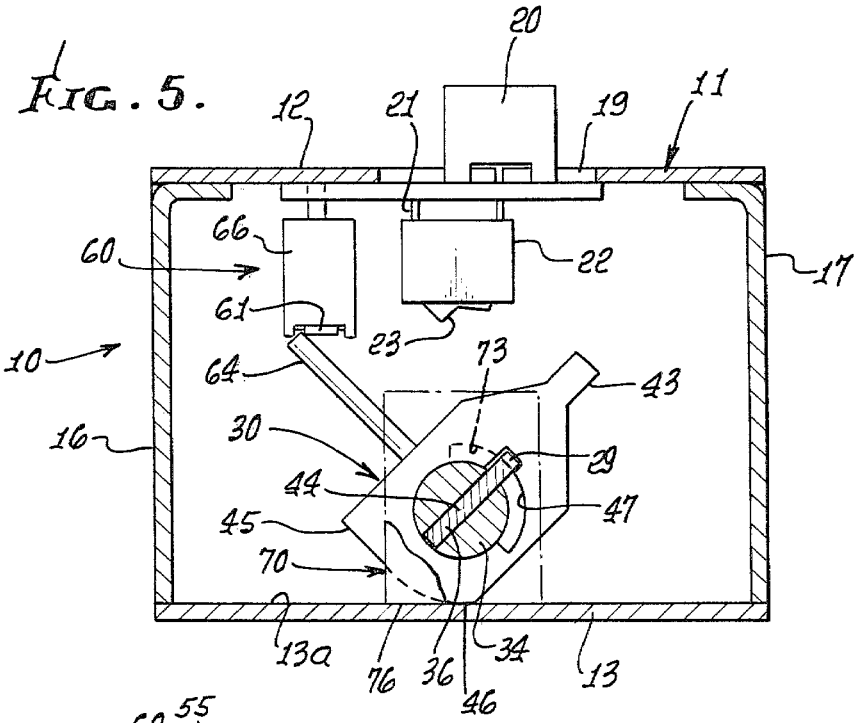
FIG. 8.
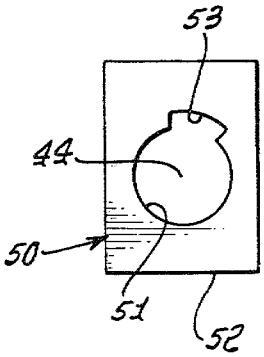
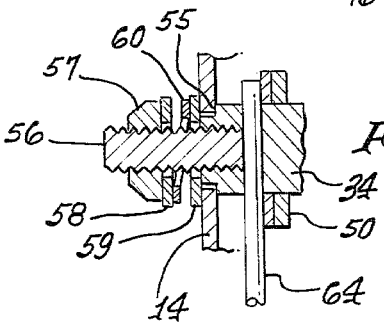
FIG. 6.

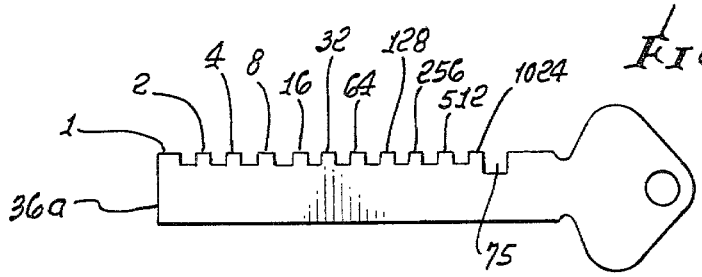
FIG. 10a.
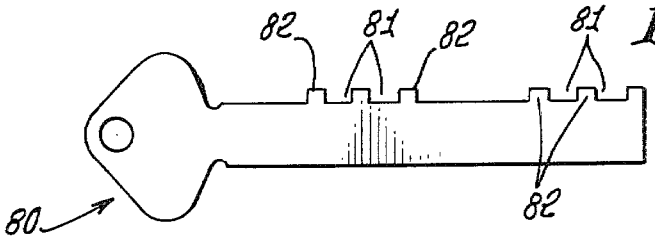
FIG. 13.
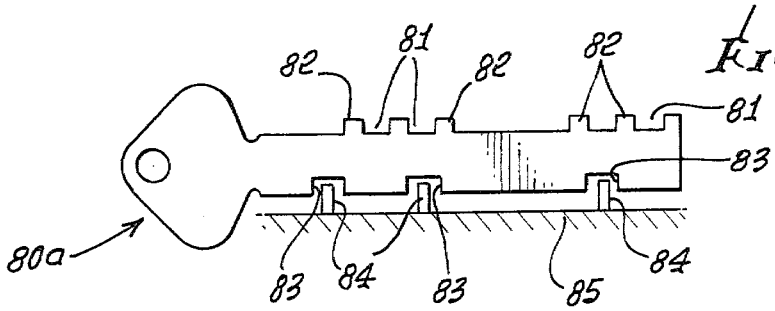
FIG. 14.
FIG. 15.
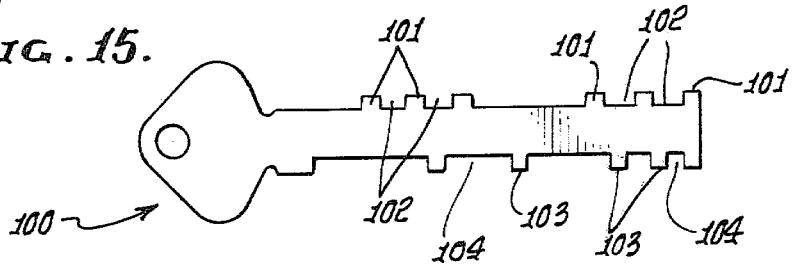
FIG. 16.
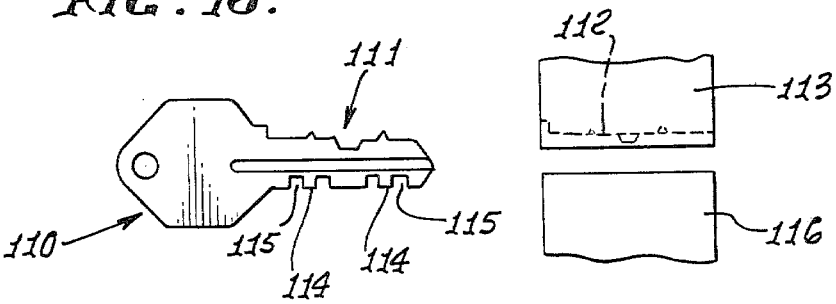

ACCESS IDENTIFICATION APPARATUS

BACKGROUND OF THE INVENTION

This invention relates generally to access identification, and more particularly concerns devices to identify a user or users of computers and related apparatus.

With the advent of microcomputers proliferating in usage, there has arisen the need to control access to such computers and other new, sophisticated and related devices. More specifically, there is need for low cost, reliable means cooperable with the computer system to identify the current user(s) uniquely, by a number which the computer can easily digest, for example a binary number. It is also important for the device which provides the identification to be able to accept a sufficient number of unique identification inputs to allow many different users to gain access to the system, if necessary. Varying levels of access for different users may be set by appropriate software coding according to the unique identifying number.

Another requirement imposed on the access identification device is "non-volatility". Many current identification devices have photo-optical or magnetic modes of operation, each mode introducing a certain volatility, or predisposition to change its preset code. In the case of photo-opticalmodes, small amounts of dirt or grease on the identification medium can impair or negate the medium's ability to provide error-free code transfer. In the case of magnetic media, spurious magnetic fields from a variety of everyday sources can cause changes in the magnetically recorded information.

Another requirement of a desirable access identification device is small size and light weight, to interface into new portable systems being built with today's technology. Yet another requirement is low power dissapation in view of dwindling available energy in the world today. Still another requirement is that the removable medium be as rugged as possible to allow indiscriminant use and transportation by the user. This feature is important to promote or enable widespread reliable usage by the general public.

Insofar as I am aware, the present invention is the first to meet the above needs.

SUMMARY OF THE INVENTION

Is is a major object of the invention to provide access identification apparatus of improved design and operation. Basically, the apparatus comprises:

(a) a plurality of switch actuating elements, (b) a key having identity shoulders corresponding to selected ones of said elements, (c) and means including structure to receive insertion of the key and responsive to movement of such identity shoulders to effect activation of the switch elements corresponding to such shoulders.

As will appear, the key receiving means typically comprises a shaft which is slotted to endwise receive the key, and the key identity shoulders project sidewardly of the shaft to selectively engage pawls to rotate same so that they in turn activate the switch actuating elements corresponding to the pawls and selected key identity shoulders. As a result, the switches enable transmission of signals that identify the particular key employed. Further, an enabling switch may be provided to be operable in response to movement (such as turning) of the key, thereby to enable the operation of associated apparatus such as a computer or terminal, for example.

Further objects include the provision of specially constructed pawls and spacers that provide highly compact mechanism associated with the binary coded key; the provision of warding mechanism to allow turning of the key only after it is fully inserted in the access identification apparatus; and the provision of binary coded keys specially adapted for use with the identification apparatus and the warding functions.

These and other objects and advantages of the invention, as well as the details of an illustrative embodiment, will be more fully understood from the following description and drawings, in which:

DRAWING DESCRIPTION

FIG. 4 is an elevation taken on lines 4—4 of FIG. 3;

FIG. 5 is a view like FIG. 4, but showing the mechanism after turning of an access key;

FIG. 6 is a horizontal section taken on lines 6—6 of FIG. 3;

FIGS. 7 and 8 are elevations showing spacers;

Figure 11:
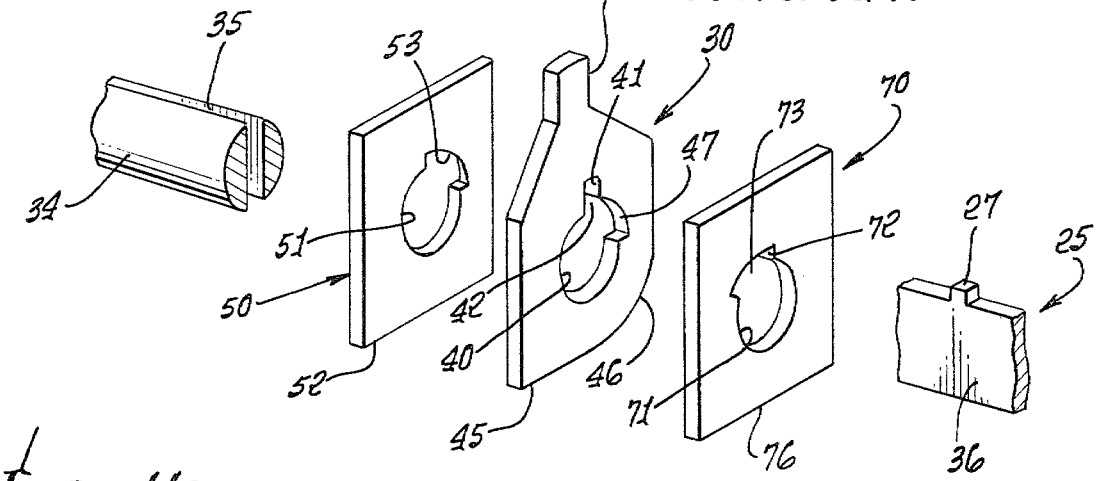
Figure 11A:
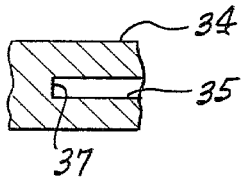
Figure 12:
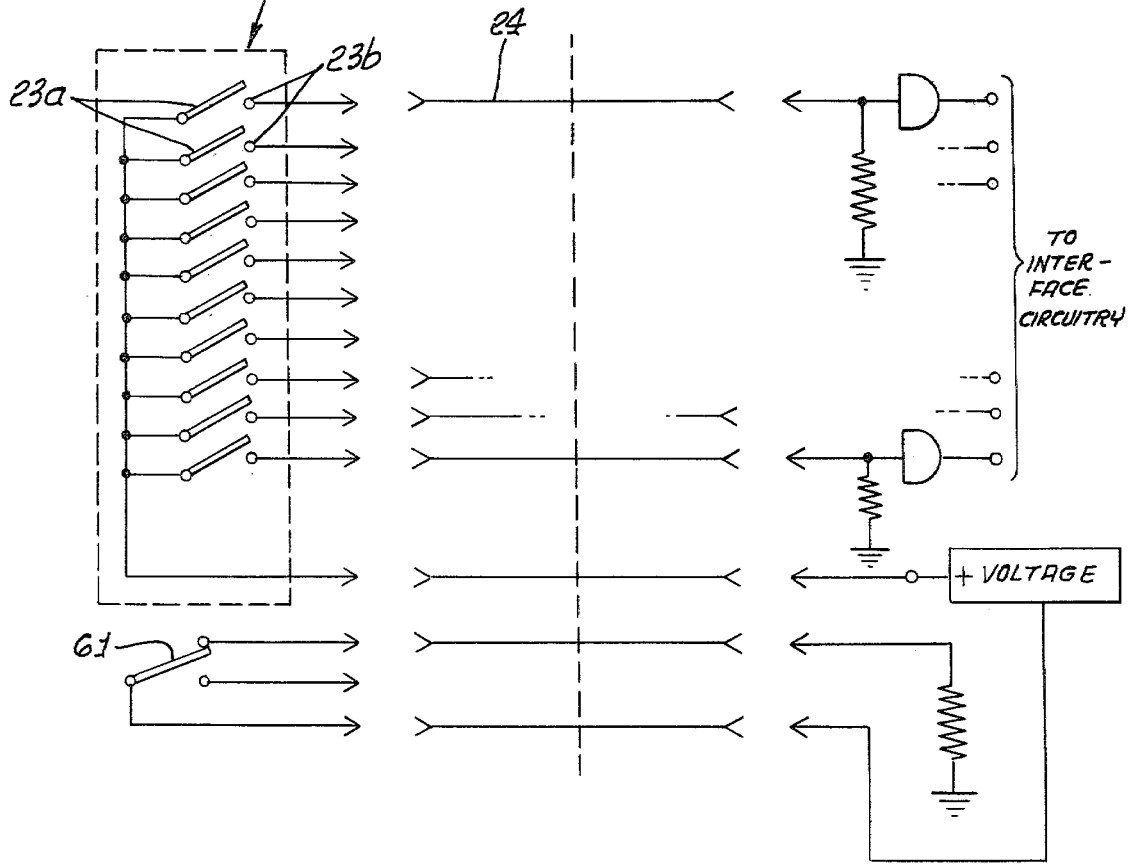

FIG. 10*a* is a fragmentary elevation showing coded key notches, and a ward notch;

FIG. 11 is an exploded view showing elements of mechanism;

FIG. 11*a* is a section through a key receiving shaft;

FIG. 12 is a circuit diagram; and

FIGS. 13–16 show modified keys.

DETAILED DESCRIPTION

Figure 1:
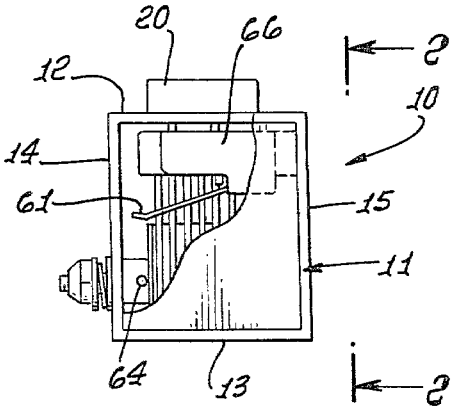
FIG. 1 is an end elevation showing apparatus incorporating the invention.
Figure 2:
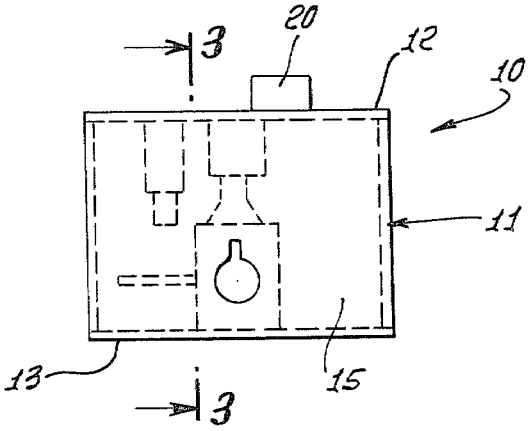
FIG. 2 is a side elevation taken on lines 2—2 of FIG. 1.
Figure 3:
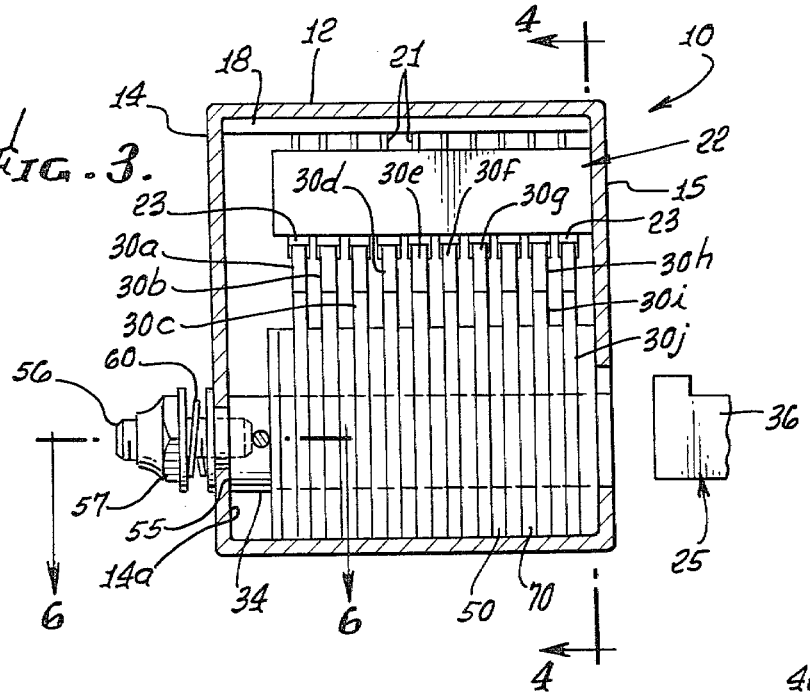
FIG. 3 is an enlarged section taken in elevation on lines 3—3 of FIG. 2.

In FIGS. 1–5, the access identification apparatus 10 includes a housing 11 having top, bottom and side walls 12–15 as shown, although it will be understood that the housing may be oriented in other directions. End walls may be provided at 16 and 17 in FIGS. 4 and 5. Located within the housing adjacent wall 12 is an insulative mounting board 18 suitably attached to wall 12, and underlying an opening 19 in that wall. Board 18 carries a terminal plug 20 having electrical pins 21 that project through board 18 and into sockets in a switch receptacle 22. The latter carries a plurality of switch actuating elements 23 (such as "dip" switches) extending in a row as seen in FIG. 3. When those elements are selectively rocked from positions shown in FIG. 4 to positions shown in FIG. 5, the switch arms 23*a* in receptacle 22 are closed. FIG. 12 shows such switch arms as closable against terminals 23*b*. The switch may be binary coded, whereby a binary coded output appears at output lead 24 corresponding to selective closing of the switches. Board 18 also has conductive circuitry to suitably connect plug 20 with the dip switches and a strobe switch.

Such selective closing is effective in response to turning of a key having identity shoulders corresponding to the selected switches to be closed. See for example key 25 in FIGS. 3, 4, 5, 10 and 11, with selected identity shoulders indicated at 26, 27, 28 and 29 corresponding to switch actuating pawls 30*a*, 30*f*, 30*i* and 30*j* in FIG. 3, to be referred to later. Such pawls, rotated in response to turning of the key, in the manner to be described, effect closing of corresponding switches via rocking of corresponding elements 23.

Also provided is means including structure to receive insertion of the key, to be responsive to movement of the identity shoulders to effect actuation of the switch actuating elements 23, corresponding to the coded identity shoulders on the key. Such means may typically and advantageously include a rotary receiver to receive insertion of the key. One such receiver comprises a shaft 34 having an axially extending slot 35 to receive the key body 36 and from which the identity shoulders (as for example at 26–29) project sidewardly free of the shaft. FIG. 4, for example, shows shoulder 29 projecting sidewardly free of the shaft 34.

FIG. 11*a* shows a portion of the shaft, in section, with slot 35 terminating an internal shaft shoulder 37. The key end 36*a* bottoms against shoulder 37 upon endwise insertion of the key into the slot, to align or locate the key shoulders (as at 26–29) relative to the pawls that activate the elements 23.

The above referenced means to effect selective actuation of the switch elements 23 may also and advantageously include pawls located on the receiver or shaft 34 to activate the respective switch actuating elements in response to rotation of the key. Such movement acts to transmit rotation of the identity shoulders on the key to corresponding pawls. An example of such a pawl is shown at 30 in FIGS. 9 and 11, and the above referenced pawls 30*a* . . . 30*j* may have the same configuration. As shown, the pawls comprise thin plates containing through openings 40 to pass the receiver in the form of the shaft 34, whereby the pawls are mounted on the shaft and allow shaft rotation relative to the pawls while the pawls remain centered by the shaft. Openings 40 are circular to loosely fit the shaft 34. The pawls have first shoulders 41 adjacent notches 42 that intersect openings 40, such shoulders located to be engaged by corresponding key identity shoulders in response to key rotation, whereby selected pawls will be rotated in response to rotation of the selected corresponding key identity shoulders. See for example FIG. 5, wherein selected key identity shoulder 29 engages first shoulder 41 to rotate corresponding selected pawl 30 clockwise as the key 25 and shaft 34 rotate clockwise.

All pawls also have projecting second shoulders as at 43 engageable with corresponding switch actuating elements, whereby those second shoulders on "selected" pawls will displace and actuate corresponding switch actuating elements. Thus, as the pawl 30 is rotated from its FIG. 4 position to FIG. 5 position, the second shoulder 43 displaces the switch actuating element "over-center" from its primary (open, for example) position seen in FIG. 4 to its secondary (closed), for example) position as seen in FIG. 5. The axis of shaft, key and pawl rotation appears at 44.

In FIG. 4, the pawls have peripheral shoulders 45 engaging the inner wall surface 13*a* to block counterclockwise rotation, and the switch actuating elements 23 position the pawl projecting shoulders 43 to yieldably block clockwise rotation. In FIG. 5, the pawls are shown to have curved peripheral extents allowing their rotation relative to the housing. See extents 46.

Figure 9:
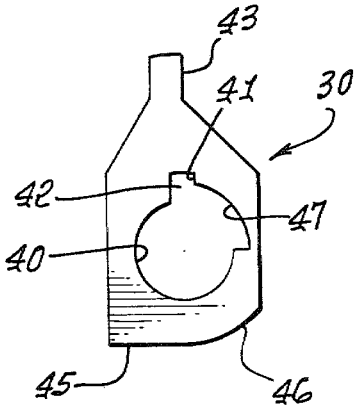
FIG. 9 is an elevation showing a pawl.
Figure 10:
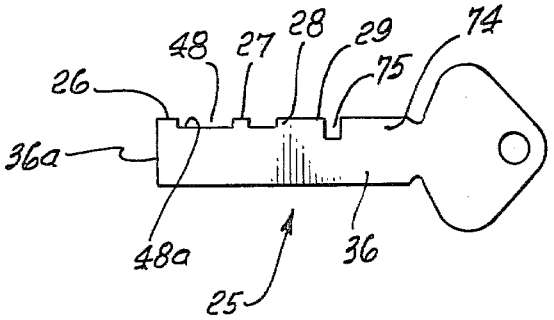
FIG. 10 is an elevation showing a key.

As seen in FIG. 9, the pawls also have sector shaped cut-outs 47 that intersect first shoulders 41, and allow rotation of the key relative to those pawls that do not correspond to the selected key identity shoulders. For example, where a "gap" 48 on the key seen in FIG. 10 is in alignment with a pawl, the gap edge 48*a* will rotate (as the key is rotated) freely in the sector shaped cut-out 47 of that pawl, and not rotate that pawl, whereby the corresponding switch actuating element will not be displaced. In this regard, the shaft and key rotate relative to such a pawl, as accommodated by opening 40 and cut-out 47, in that pawl.

Also provided, in the example, are spacers in the form of thin plates between successive pawls, to space the pawls with axial separation, whereby the identity shoulders on the key may be spaced apart. One form of such a spacer appears at 50 in FIG. 8. It contains a through opening 51 (which may be circular) to pass the shaft 34, with loose interfit, allowing shaft rotation relative to the spacer. The spacer has a first peripheral stop shoulder at 52 to engage auxiliary structure such as case inner surface 13*a*, to block spacer rotation. Also, the spacer has a sector-shaped cut-out at 53 to allow key shoulder rotation during key, shaft and selected pawl rotation for actuation of the selected switch activating elements. See FIGS. 4, 5 and 8 in this regard.

Shaft 34 is mounted to the case or housing for rotation with the key and relative to the spacers 50, as referred to. As shown in FIG. 3, the shaft is centered relative to the housing by sliding engagement of its flat end surface 55 with the inner side 14*a* of wall 14. Means holding the shaft in that centered position includes a threaded insert 56 projecting from the end of the shaft and through wall 14, nut 57 on the insert, washers 58 and 59 adjacent the outer side of wall 14 and adjacent the nut, and spring 60 compressed between the washers. Accordingly, a very simple mount is provided, and is easy to assemble and disassemble. See also FIG. 6.

Also provided within the housing is an enabling switch operable in response to pawl displacing movement of the key to enable operation of the apparatus, i.e. transmission or utilization of signals from the switches 23, for example. See for example enabling switch 60 having plunger 61 that is displaced as the shaft 34 and key 25 are rotated. FIGS. 4 and 5 show that when the shaft is rotated, a pin 64 on the shaft engages the plunger to displace it, enabling the switch 60. See also FIG. 12. An enabling switch housing is indicated at 66, and mounted to plate 18. Further rotation of shaft 34 is stopped by "ungapped" sections of the key engaging ends of sector cutouts 53 in spacers which cannot rotate because of surfaces 52.

A further aspect of the invention concerns the provision of ward means to block turning of the key until it is in fully inserted position in the receiver or shaft 34. As shown in FIGS. 7 and 10, the ward means may advantageously comprise at least one auxiliary spacer comprising a plate 70 having a through opening 71 to pass the shaft 34, whereby the plate is mounted on the shaft and allows rotation thereof relative to that spacer. Opening 71 may be circular to loosely interfit the shaft. The spacer also has a stop shoulder 72 formed by cut-out 73, and located to be engaged by the key structure 74 and 29 (at opposite sides of gap or notch 75 in the key) and block key rotation until gap 75 registers with stop shoulder 72 upon full insertion of the key into the receiver or shaft. Upon such registration, the key will turn, because gap 75 passes the stop shoulder. The plate 70 also has a peripheral stop shoulder 76 engageable with internal wall 13*a* to block rotation of the spacer, about axis 44. Notch 75 is shown as deeper than the gaps between the identity shoulders, so that accidental registration of such gaps with stop shoulder 72 will not allow turning of the key. Note in FIG. 10*a* that the gaps between the full range of selectable identity shoulders are labeled 1, 2, 4, 8 . . . 512 to correspond to binary encoded switch selection.

FIG. 13 shows a basic key 80 with binary coded notches 81 and shoulders 82 spaced along one of its edges; and FIG. 14 shows the same key 80*a* with multiple ward notches 83 formed in its opposite edge. Fixed ward pins 84 are associated with lock structure 85, and only when the key is fully inserted so that notches 83 register with pins 84 will the key turn. Otherwise, the lock structure may be the same as described in FIGS. 1–9.

FIG. 15 shows a modified key 100 with extended binary coded notches and shoulders along both edges of the key; see for example shoulders 101 and notches 102 along one edge, and shoulders 103 and notches 104 formed along the opposite edges of the key. Shoulders and notches 103 and 104 are staggered relative to shoulders 101 and notches 102, so that improper insertion of the key prevents rotation of the key in the lock.

In FIG. 16, a house key 110 has surface 111 grooved or cut to a pattern along one edge of the key to match tumblers indicated at 112 in lock 113, to allow turning of the key. In addition, the key has binary coded shoulders and notches 114 and 115 formed along the key opposite edge, in the manner described above in FIGS. 1–9. Lock structure 116 corresponds to the structure described above that receives the key. Thus, the cut surfaces 111 act as warding to allow key rotation only when those particular keys are used which match tumblers 112; and then, the particular user is identified by his particular binary coding at 114 and 115.

Further advantages are listed as follows:

The "device" consumes virtually no power until it is activated by insertion of the removable medium such as the key. It can be made compatible with all types of available electronic logic. The medium or key is typically embodied in solid steel or hard brass (or any other appropriate material which provides strength and stability) and information bits may be cut into the material with an information density of 10 bits per inch. This low density provides two immediate benefits:

(a) allows the readable medium to interface and activate 10/inch electronic switch assemblies which are used for the readout; and (b) provides large margins for readout sensors allowing error free interpretation of medium data.

The shape of the medium, that of an ordinary key, provides an additional benefit: the user has a ready-made carrying device (key ring) and predisposition to carrying the medium.

Also, on the printed circuit board assembly there may be included:

(a) a hysteresis switch which is positioned so as to be activated after all rockers have been set (or not). This switch provides a "strobe" which tells the interfacing electronics to take the data, (b) a 20 pin output connector which provide a way of interfacing the "device" with other sections of the electronic system.

The unit is designed so that the printed circuit board assembly can be removed without disturbing the other elements of the device. Therefore, any failures due to wearout of the dipswitch or strobe switch can be replaced or repaired by exchanging the board assembly.

It should be noted that the 10 position key allows, in the binary system, a total of two to the tenth power, minus one, or 1023, separate, unique identifications. Actually 1024 are available; but as a practical matter, binary 0 and 1023 identities represents keys in which all identity shoulders are either missing or present, respectively; since these combinations are too easy to obtain, they would most properly be omitted from the allowable number file within the host device (mini/microcomputer or other electronic interface).

I claim:

1. In access identification apparatus, (a) a plurality of switch actuating elements, (b) a key having identity shoulders corresponding to selected ones of said elements, (c) means including structure to receive insertion of the key and responsive to movement of said identity shoulders to effect activation of the switch elements corresponding to said shoulders, and (d) a housing and a receptacle mounted on the housing, said receptacle carrying said switch actuating elements to be rocked back and forth between two positions by said structure which includes plates having exterior tangs engageable with said respective elements, said elements rocking counterclockwise as said tangs rotate clockwise, and vice versa.

2. The apparatus of claim 1 including an enabling switch operable in response to movement of the key to enable operation of associated apparatus.

3. The apparatus of claim 2 including a computer associated with said enabling switch to be enabled thereby.

4. The apparatus of claim 1 wherein said means includes a rotary receiver to receive said insertion of the key.

5. The apparatus of claim 4 wherein said receiver comprises a shaft having an axially extending slot to receive the key with said identity shoulders projecting sidewardly free of the shaft.

6. The apparatus of claim 1 wherein said ward means includes at least one auxiliary spacer comprising a plate having a through opening to pass the shaft and allow shaft rotation relative thereto, said auxiliary spacer having a stop shoulder to be engageable by the key to block key rotation until a gap on the key registers with said stop shoulder, allowing key rotation when the key is in fully inserted position in the receiver.

7. The apparatus of claim 5 including ward means to block turning of the key until it is fully inserted in said receiver.

8. The apparatus of claim 4 wherein said means includes a receiver to receive the key, and pawls located on said receiver to actuate the respective switch actuating elements in response to rotation of the key acting to transmit rotation of said identity shoulders to corresponding pawls.

9. The apparatus of claim 8 including spacers between the pawls, whereby the identity shoulders on the key may be spaced apart.

10. The apparatus of claim 8 wherein the pawls comprise plates containing through openings to pass the receiver in the form of a shaft, and to allow shaft rotation relative to the pawls while the pawls remain centered by the shaft.

11. The apparatus of claim 10 wherein the pawls have first shoulders to be engaged by corresponding key identity shoulders in response to key rotation whereby selected pawls will be rotated in response to rotation of the selected corresponding key identity shoulders, and all pawls have second shoulders engageable with corresponding switch actuating elements, whereby the second shoulders on the selected pawls will displace and activate corresponding switch actuating elements in response to selected pawl rotation by the key.

12. The apparatus of claim 11 wherein said pawls have sector shaped cut-outs intersecting said first shoulders, to allow rotation of the key relative to those pawls that do not correspond to said selected key identity shoulders.

13. The apparatus of claim 12 including spacers between the pawls, whereby the identity shoulders on the key may be spaced apart, said spacers comprising plates having through openings to pass the shaft and to allow shaft rotation relative to the spacers.

14. The apparatus of claim 13 wherein the spacers having first stop shoulders to engage auxiliary structure and block spacer rotation, and sector-shaped cut-outs to allow key shoulder rotation during key, shaft, and selected pawl rotation for activation of selected switch actuating elements.

15. The apparatus of claim 14 wherein the shaft is mounted for rotation with the key, and relative to the spacers.

16. The apparatus of claim 11 including mounting means having a surface blocking rotation of the spacers.

17. The apparatus of claim 11 wherein the receiver comprises a shaft having a slot into which the key is insertible with said identity shoulders projecting sidewardly free of the shaft, the pawls and spacers having openings to pass the shaft, and the pawls having shoulders to be engaged by the key identity shoulders.

18. The apparatus of claim 17 wherein the shaft has a surface generally normal to the shaft axis, there being means holding said shaft surface in sliding engagement with an auxiliary surface to center the shaft for rotation.

19. For use in combination with access identification apparatus that includes (a) a plurality of switch actuating elements, and (b) means including structure to receive insertion of a key and responsive to movement of said identity shoulders to effect activation of the switch elements corresponding to said shoulders, and a housing and a receptacle mounted on the housing, said receptacle carrying said switch actuating elements to be rocked back and forth between two positions by said structure which includes plates having exterior tangs engageable with said respective elements, said elements rocking counterclockwise as said tangs rotate clockwise, and vice versa, the improvement comprising (c) the key having identity shoulders corresponding to selected ones of said elements, the key insertible in structure defined by said means to be movable for effecting said activation.

20. The improvement of claim 19 wherein said key has gaps between said identity shoulders.

21. The improvement of claim 20 wherein the key has an additional notch registrable with a stop shoulder defined by said structure when the key is fully inserted, to allow turning of the key, the key having shoulders adjacent said additional notch to engage said stop shoulder and block key turning when the key is not fully inserted.

22. The improvement of claim 19 wherein said identity shoulders are spaced along opposite elongated edge portions of the key.

23. The improvement of claim 22 wherein the identity shoulders spaced along one elongated edge are staggered relative to the identity shoulders spaced along another elongated edge of the key.

24. The improvement of claim 19 wherein the identity shoulders are spaced along one edge of the key, the key opposite edge having cuts allowing key insertion into a lock to engage corresponding tumblers.

25. In access identification apparatus, (a) a plurality of switch actuating elements, (b) a key having identity shoulders corresponding to selected ones of said elements, (c) and means including structure to receive insertion of the key and responsive to movement of said identity shoulders to effect activation of the switch elements corresponding to said shoulders, said means including a rotary receiver to receive said insertion of the key, and pawls located on said receiver to actuate the respective switch actuating elements in response to rotation of the key acting to transmit rotation of said identity shoulders to corresponding pawls, (d) said pawls comprising plates containing through openings to pass the receiver in the form of a shaft, and to allow shaft rotation relative to the pawls while the pawls remain centered by the shaft, the pawls having interior first shoulders to be engaged by corresponding key identity shoulders in response to key rotation whereby selected pawls will be rotated in response to rotation of the selected corresponding key identity shoulders, and the pawls having exterior second shoulders engageable with corresponding switch actuating elements, whereby the second shoulders on the selected pawls will displace and activate corresponding switch actuating elements in response to selected pawl rotation by the key, (e) the pawls also having sector shaped cut-outs intersecting said first shoulders outwardly of said openings, to allow rotation of the key relative to those pawls that do not correspond to said selected key identity shoulders.

26. The combination of claim 25 wherein said switch actuating elements are carried by a housing so as to rock counterclockwise as the pawls rotate clockwise, and vice versa.

* * * * *

UNITED STATES PATENT AND TRADEMARK OFFICE

CERTIFICATE OF CORRECTION

PATENT NO. : 4,333,328

DATED : June 8, 1982

INVENTOR(S) : John D. Platt

It is certified that error appears in the above-identified patent and that said Letters Patent are hereby corrected as shown below:

Column 6, line 37, change "6. The apparatus of claim 1 wherein said ward means" to --6. The apparatus of claim 7 wherein said ward means--

Signed and Sealed this

*Fifth* Day of *October* 1982

[SEAL]

*Attest:*

GERALD J. MOSSINGHOFF

*Attesting Officer*

*Commissioner of Patents and Trademarks*